United States Patent [19]

Baum

[11] 4,051,909

[45] Oct. 4, 1977

[54] TURBINE DRILL FOR DRILLING AT GREAT DEPTHS

[75] Inventor: Werner Baum, Canoga Park, Calif.

[73] Assignee: P.E.I. Incorporated, Canoga Park, Calif.

[21] Appl. No.: 743,914

[22] Filed: Nov. 22, 1976

[51] Int. Cl.[2] ..... E21B 3/08

[52] U.S. Cl. ..... 175/93; 175/107

[58] Field of Search ..... 175/93, 107

[56] References Cited

U.S. PATENT DOCUMENTS

| | | | |
|---|---|---|---|
| 2,673,069 | 3/1954 | Carpenter | 175/93 |
| 2,828,945 | 4/1958 | New | 175/93 |
| 3,083,779 | 4/1963 | Rowley | 175/93 |
| 3,280,923 | 10/1966 | Muench | 175/93 |
| 3,620,313 | 11/1971 | Elmore | 175/93 |

*Primary Examiner*—James A. Leppink
*Attorney, Agent, or Firm*—Richard H. Zaitlen

[57] ABSTRACT

A drilling device is disclosed which comprises a tubular drilling lance adapted to being lowered to great depths in the earth's surface and being raised therefrom. Disposed within the drilling lance is an energy generating system which comprises a fluid vaporizing system and a turbine coupled to the vaporizing system by a closed fluid circuit. Coupled to the turbine and extending outwardly from the drilling lance is a drill bit. The drilling device is configured such that vaporized fluid activates the turbine, which in turn, makes the drill bit operable.

18 Claims, 8 Drawing Figures

TURBINE DRILL FOR DRILLING AT GREAT DEPTHS

BACKGROUND OF THE INVENTION

1. Field of the Invention

The present invention relates to the field of drilling devices, and more specifically, to drilling devices with turbine propulsion.

2. Prior Art

As the world's supply of natural resources diminishes, greater efforts are being required to recover such resources. For example, with the diminishing supply of crude oil and natural gas, greater efforts have been required to recover these minerals. Thus, well drilling to greater depths to recover minerals has been necessitated. However, the increased formation of pore fluid pressures existing at great depths in the earth's crust, adversely affects current drilling methods. Also, with the increased distances involved in drilling at great depths, it has been difficult to effeciently supply adequate energy to the drilling site.

One prior art attempt to generate energy close to the drilling site is a turbine drill wherein hydraulic turbines are utilized. In these devices, the rotor of the turbine is directly coupled with the roller bit, and the fluid used to activate the turbine, the working fluid, is expelled so that it can be used to flush drilling debris up and away from the drilling device. One problem with such turbine drills is that their efficiency of operation is not independent of the depth at which the drilling device is being used. That is, as the drilling device is being lowered to greater depths, it takes a greater amount of energy to generate and expel the working fluid. Another problem with such turbine drills is their vulnerability to damage caused by rocks and other debris which is suspended in the working fluid. Since the working fluid is used to activate the turbine, the turbine and its associated feed mechanisms are subject to severe damage. A further problem both with the prior art hydraulic turbine drills and with earth drilling devices in general is the vulnerability of the drill bits they utilize. That is, the prior art devices only provide a constant force and drill bit rotation rate. As these drill bits bore through material which varies in both density and hardness, the unregulated force and rotation rate frequently results in broken bits. What is needed is a turbine drilling device which can be operated at great depth with a high energy output but without a loss of efficiency or susceptibility to damage.

In the present invention, the problems of efficiency loss at great depths have been eliminated by the utilization of an energy generating system which requires little energy for the expulsion of exhaust gasses, and a closed fluid circuit in conjunction with a turbine drilling device. More specifically, the energy generating system, which is disposed in a drilling lance, utilizes combustion techniques which produce little waste gasses. Thus, only a minimum amount of energy is required to expel such gasses, even at great working depths where the external pressures are high. The generating system comprises a fluid vaporizing system and a turbine coupled to the vaporizing system by a closed fluid circuit. That is, the fluid utilized in activating the turbine is not expelled from the device but is recirculated in a closed circuit. In the configuration of the present invention, the combustion process, the fluid vaporizing system, and the turbine coupled to the vaporizing system, operate virtually independently of external pressures.

The present invention allows a self-contained energy generating system to be lowered directly to the drilling site. By this approach, no energy is required to force fuels to great depths where these devices are being utilized, while a high power density can be generated directly at the drilling site. Furthermore, since the fluid utilized to activate the turbine is not drawn from the working fluid surrounding the drilling device, damage to the turbine from debris is virtually eliminated. This allows the present invention to have a longer time between failures and a greater life span. In addition, the energy generating system, the drilling means, and the force applied to the drilling means are controlled by a control means. This control means senses various parameters and regulates the drilling rate and energy expended so that maximum drilling efficiency is maintained. Through this control means, variations in drilling material density and hardness may be sensed and compensated for so that the life of the drilling means is greatly increased.

BRIEF SUMMARY OF THE INVENTION

The present invention is a drilling device having special utility for drilling at great depths in the earth's surface. The drilling device comprises a tubular drilling lance, an energy generating system disposed in the drilling lance, and a drilling means.

The tubular drilling lance is a device for carrying a self-contained energy generating system and a drilling means directly to a drilling site which may be at a great depth in the earth's surface. The lance may be lowered to the drilling site and raised therefrom by relatively light, thin-walled drill pipe.

The energy generating system is slideably disposed within the drilling lance. The generating system is characterized by a fluid vaporizing system, a turbine coupled to the vaporizing system by a closed fluid circuit, a hydro-propulsion means, and a control means. The fluid vaporizing system comprises at least one fuel container, a reaction chamber coupled to the fuel container, a heat exchanger coupled to the reaction chamber such that heat from the chamber is transferred to the heat exchanger, vaporizable fluid communicating with the heat exchanger such that the fluid is caused to vaporize by the transferred heat, and a condenser means directly coupled to the heat exchanger such that the vaporizable fluid is selectively cooled and returned to the heat exchanger without loss of the fluid. In operation, the drilling lance, including the self-contained energy generating system, is lowered to the drilling site. Then, fuel from the fuel container is either burned or allowed to decompose in the reaction chamber, thereby generating heat which is transferred to the heat exchanger. The fuels utilized in the combustion or decomposition are chosen so that only a minimum amount of exhaust gasses must be expelled. By utilization of such fuels, little energy is required for the expulsion of the resulting by-products, even at high external pressures.

A turbine is coupled to the vaporizing system by a closed fluid circuit. That is, in secondary circulation in the heat exchanger is a vaporizable fluid which is heated and becomes vaporized. The vaporized fluid is then coupled to a turbine thereby activating the turbine. Upon return from the turbine, the vapor is cooled in a condenser means and then recirculated to the heat exchanger, without a loss to the external environment.

An additional component of the energy generating system is a hydro-propulsion means. This propulsion means is a device which, when activated, expands in a direction along the axis of the lance. The propulsion means is used to exert a controlled pressure on the drilling means, so that an efficient drilling rate is maintained, and to extend the drilling means beyond the lance so that the drilling means may progress further downward without moving the drilling lance.

The final component of the energy generating system is a control means which is used to provide the maximum efficiency drilling rate while protecting the drill bit from damage. The control means senses various parameters, including component forces and angular velocities, and controls both the force being applied to the drilling means by the hydro-propulsion means and the rotational rate of the drilling means. Through such a control means, variations in the material being drilled can be sensed and compensated for so that both the drill bit is protected and the most efficient drilling rate is maintained.

Extending outwardly from the bottom end of the drilling lance is the drilling means. The drilling means is coupled to the turbine such that activation of the turbine by the fluid vaporizing system causes activation of the drilling means. The drilling means may be coupled to the turbine by: (i) direct mechanical linkage, (ii) electro-generator/electro-motor coupling, or (iii) hydro-generator/hydro-motor coupling. Thus, the present invention allows a high output energy generating system to be lowered directly to the drilling site. Since the energy generating system is self-contained, there is no losses associated with energy transmission from the earth's surface. Also, because the turbine and the vaporizing system form a closed fluid circuit, and because little energy is required for expulsion of exhaust gasses, the energy available for drilling is virtually independent of the depth at which the device is utilized.

The novel features which are believed to be characteristic of the invention, both as to its organization and method of operation, together with further objectives and advantages thereof, will be better understood from the following description considered in connection with the accompanying drawings in which a presently preferred embodiment of the invention and alternate embodiments are illustrated by way of example. It is to be expressly understood, however, that the drawings are for the purpose of illustration and description only, and is not intended as a definition of the limits of the invention.

DETAILED DESCRIPTION OF THE INVENTION

Figure 1:
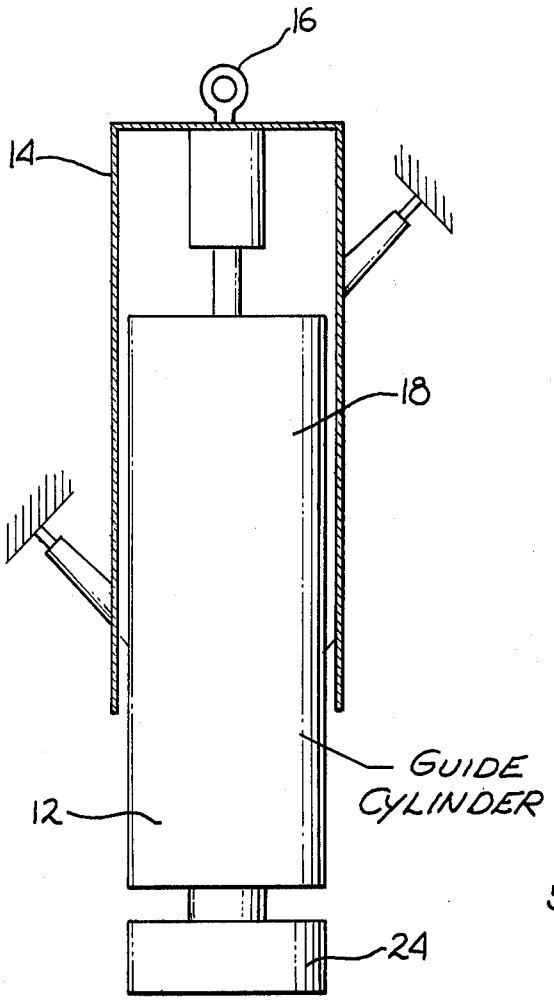
FIG. 1 is a diagrammatic illustration of the drilling device of the present invention.

Referring first to FIG. 1, a tubular drilling lance 10 is illustrated with fastening device 16 attached to the top end 14 of the lance 10. Lance 10 is a generally elongated tube-like structure, adapted for being lowered to great depths in the earth's surface. Slideably disposed within drilling lance 10 is the energy generating system 18. As will be described more fully below, energy generating system 18 is a self-contained power generator which is adapted to being lowered directly to the drilling site. Also illustrated in FIG. 1 is the drilling means 24 extending outwardly from the bottom end 12 of the tubular drilling lance 10. Bottom end 12 of drilling lance 10 is configured to resist the counter-torque resulting from the force developed by drilling means 24 so that the drilling means is maintained in an axial direction, and to guide the energy generating system as the system 18 slides within lance 10.

Figure 3:
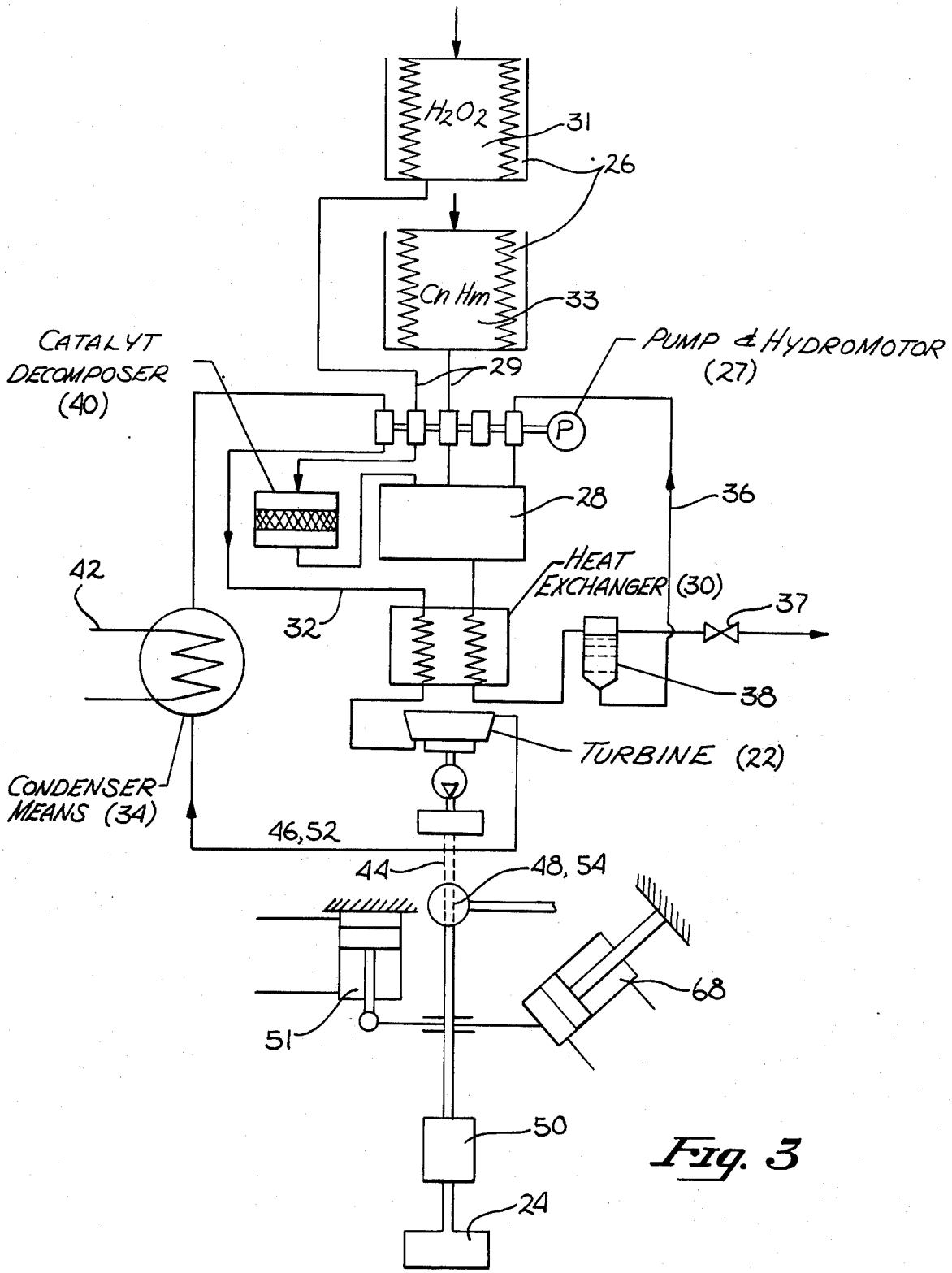
FIG. 3 is a block diagram of the energy generating system and its coupling to the drilling means.

Now referring to FIG. 3, the block diagram of the energy generating system 18 is illustrated. Fuel containers 26 are coupled to the reaction chamber 28. One fuel container 26 is shown coupled through catalytic decomposer 40. The reaction chamber 28 is coupled to the heat exchanger 30 such that the heat and exhaust gasses from the reaction chamber are transferred to the heat exchanger. Water, or other liquid coolant 36, is separated from the exhaust gases of heat exchanger 30 by coupling 38 and returned to the reaction chamber 28, while waste gasses are exhausted by port 37. Liquid coolant 36 may be utilized to cool the internal jacket of reaction chamber 28 or to dilute the fuel contained in chamber 28.

In secondary circulation in the heat exchanger is vaporizable fluid 32. The vaporizable fluids which may be utilized in the present invention are a halogenated hydrocarbon such as Freon or water. The fluid is conducted through the heat exchanger 30 such that it absorbs heat and becomes vaporized. The vaporized fluid is then coupled to turbine 22 where it activates the turbine. Upon its exit from turbine 22, the vaporized fluid is returned to condenser means 34 where it is cooled by the secondary circulation of coolant 42 and then recirculated to heat exchanger 30. Thus, it can be seen that vaporizable fluid 32 is conducted through heat exchanger 30, turbine 22 and condenser means 34 by a closed fluid circuit such that no fluid is allowed to escape into the surrounding environment. Because the circuit is closed, the pressure, volume and heat carrying capacity of the fluid remains constant and independent of the external pressures. Therefore, the energy output of the turbine 22 remains independent of external pressures.

FIG. 3 also illustrates the direct mechanical linkage 44 between the turbine 22 and the drilling means 24. Alternate means of coupling are also illustrated. These consist of electric generator 46 coupled to turbine 22 and electro-motor 48 coupled to drilling means 24, or hydro-generator 52 coupled to turbine 22 and hydro-motor 54 coupled to drilling means 24. Hydraulic piston 68 is utilized to stabilize drilling means 24, while hydro-propulsion means 51 is used to provide propulsion of the drilling means as will be described more fully below.

It can also be seen in FIG. 3 that fuel container 26 is a collapsable bellow-like container configured such that external pressure on the container provides a positive pressure on the fuel contained therein. Through this manner of construction, as the drilling lance is lowered into the earth's surface, the pressure generated by the drilling fluids is exerted on the collapsable bellows thereby providing the pressure necessary to feed fuel to the reaction chamber. Fuel containers 26 may also be constructed of a flexible bladder material. By utilizing the drilling fluid pressure available at the drilling site, little energy need be expended to feed fuel to reaction chamber 28. Thus, pump and hydro-motor 27 are only required to overcome the relatively minor tubing resistance of the coupling between the containers 26 and the reaction chamber 28. Of course, fuel containers 26 may be eliminated if the fuel is fed from the surface by fuel lines 29.

Reaction chambers such as chamber 28 are well known in the prior art. For example, disclosed in U.S. Pat. No. 3,169,368, issued to Munding, which is herein incorporated by reference, is a combustion chamber construction and operation. Munding discloses a rocket engine which has a combustion chamber, and means for directing a cooling agent tangentially in the chamber walls so as to provide a cooling function. The present invention, while capable of using such combustion chamber designs, can use other chambers such as are readily known in the art.

Figure 4:
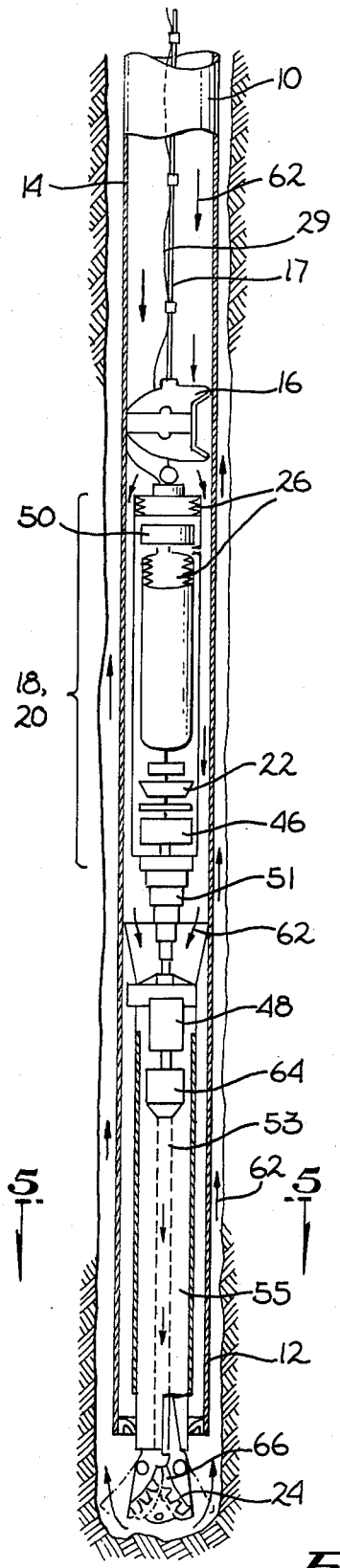
FIG. 4 is a detailed drawing of the drilling lance and its constituent components.

FIG. 4 shows in greater detail one preferred embodiment of the drilling device. The tubular drilling lance 10 is shown with its top end 14 and bottom end 12. Disposed within the drilling lance is fastening device 16, energy generating system 18, and drilling means 24. Fastening device 16 is used for coupling lance 10 to the earth's surface by cable 17 and for wedging the slideably disposed energy generating system 18 in the appropriate location within lance 10. The component parts of the energy generating system 18, disposed within the drilling lance 10, are the fluid vaporizing system 20, fuel container 26, turbine 22 coupled to fluid vaporizing system 20, control means 50 and hydro-propulsion means 51. Coupled to the turbine is electro-generator 46 which is in turn electrically coupled to electro-motor 48. Electro-motor 48 is then coupled to drilling means 24.

Also shown in FIG. 4 is mud and drilling debris 62 circulation. Mud 62 is initially drawn into drilling lance 10 above the top end 14. It then drops through the interior of lance 10 until it is drawn into mud pump 64. Pump 64 pressurizes the mud and forces it out through mud jet 66 where it is guided through the drilling means 24. This pressurized mud forces debris, which has accumulated from the action of drilling means 24, away from the drilling means and up along the exterior of lance 10. It is important to note that mud and debris 62 is not circulated through turbine 22 but instead is only directed through those passages and mechanisms which are virtually impervious to damage from such debris.

In operation, drilling lance 10 is lowered to the drilling site, where the energy generating system 18 is activated. Upon activation, drilling means 24 begins to rotate such that the material immediately before the drilling means is pulverized. This pulverized material is urged up and away from the immediate drilling site by the flow of mud 62. Constant force is maintained on drilling means 24, so that maximum drilling progress can be continued, by hydro-propulsion means 51. That is, hydro-propulsion means 51 expands in a direction along the axis of lance 10, thereby applying direct mechanical pressure to drill member 53. Since drill member 53 is directly coupled to drilling means 24, the drilling means is urged against the material being drilled at a constant pressure, while at the same time the drilling means continuously extends further from the drilling lance 10.

Hydro-propulsion means 51 will continue to expand as drilling means 24 progresses through the earth's surface. However, propulsion means 51 has a maximum length to which it can extend. When this maximum extension point is reached, the drilling progress is discontinued while propulsion means 51 can be contracted to its minimum length position. Then, fastening device 16 is loosened, from its wedged condition against the interior surface of lance 10, by control signals from the drilling operator. Since energy generating system 18 is slideably disposed in lance 10, such loosening of fastening device 16 allows the entire system 18 to slide through lance 10 until drilling means 24 again abuts the drilling surface.

When this sliding operation is completed, fastening device 16 is again expanded so that it becomes wedged against the interior surface of lance 10. Expansion of hydro-propulsion means 51 can then start so that further drilling progress can be accomplished. Depending on the specific length of lance 10 and the maximum length of propulsion means 51, such alternate steps of drilling and sliding can continue until energy generating system 18 is located in some maximum extended position within lance 10. When such a maximum position is reached, the entire lance can be brought to the surface for filling of the fuel containers and another section of drill pipe may be coupled to that pipe already in use. Then, the alternate steps of drilling and sliding may be continued.

Conventional drilling techniques require heavy, thick-walled, drill pipe since the power used to rotate the drill bit is coupled from the generating system on the earth's surface to the drilling site by the drill pipe. Because lance 10 carries within it a self-contained energy generator, drilling energy does not have to be transmitted from the earth's surface to the drilling site through the drill pipe. Consequently, the drill pipe required for the present invention is a relatively light, thin-walled tubular structure. This lighter drill pipe also allows much lighter equipment to be used on the surface, since a greatly reduced amount of weight will be raised and lowered. Thus, the drill pipe utilized in the present invention need only be sufficiently strong to support the combined weight of lance 10 and the drill pipe itself as it is being raised and lowered, and to oppose the torque coupled to the drill pipe by the drill bit.

From FIGS. 3 and 4 it can be seen that a great variety of fuels may be used to generate heat in reaction chamber 28. In general, there are two methods by which liquids can undergo chemical reactions to form heat in reaction chamber 28 — decomposition, which would require the use of only one substance in the liquid state, and combustion, which requires the use of two or more. Such systems are therefore designated by the names monopropellant and bipropellant, respectively. There are, of course, many liquids that decompose by exothermic reactions. However, two of the most useful liquids are hydrogen peroxide and hydrazine. If a monopropellant fuel system is utilized in the present invention, then only one fuel container 26 is required.

However, if two liquids are used in a bipropellant system, then two fuel containers 26 would be required. One container would hold a fuel such as a hydrocarbon compound 33, and the other container would hold an oxidizing agent 31, such as hydrogen peroxide. The oxidizing agent must then be coupled to the reaction chamber by means of the catalytic decomposer 40 wherein a catalyst, such as silver, will be utilized. With hydrocarbon and oxidizer combustion, an energy output of more than two hundred kilowatts can be expected with a fuel consumption of only 2.5 kilograms per kilowatt hour.

The utilization of a nitrogen free hydrocarbon compound and hydrogen peroxide is the presently preferred combination of fuel and oxidizer because of the relatively small amount of exhaust gasses which are produced from the resulting combustion. That is, in the combustion of a hydrocarbon compound in the presence of an oxidizer, only carbon dioxide and water are produced as waste by-products. As noted earlier, the water is separated from the exhaust gasses by coupling 38 and returned to the reaction chamber 28, while the waste gasses are exhausted by port 37. And, since the combustion of a hydrocarbon compound in the presence of an oxidizer produces only a small amount of carbon dioxide, little energy is required to expel such waste gasses through port 37. Then, even when the energy generating system is lowered to great depths where the external pressures are high, little energy need be wasted to exhaust the resulting carbon dioxide. Thus, the presently preferred combination of a hydrocarbon compound and hydrogen peroxide, as the fuel and oxidizer respectively, allows the present invention to remain highly efficient, even at great depths and pressures. However, other fuel combinations may be used in a bipropellant system, including: (1) hydrazine and nitrogen tetroxide, (2) hydrazine and nitric acid, and (3) hydrazine and hydrogen peroxide.

Several alternate means are available for coupling the turbine 22 to the drilling means 24. One such coupling consists of a direct mechanical linkage 44 between the turbine 22 and the drilling means 24. Another coupling means may consist of electric generator 46 coupled to the turbine and electro-motor 48 coupled to the drilling means 24 such that activation of the turbine generates electricity by electro-generator 46 and this electricity is coupled to electro-motor 48, which in turn activates drilling means 24. A third alternate coupling may consist of hydraulic pump 52 coupled to turbine 22 and hydromotor 54 coupled to drilling means 24 such that activation of the turbine causes the hydraulic pump to activate the hydromotor and thereby make the drilling means 24 operable. Of course, the energy generated by the present invention may be utilized in mixed drilling techniques, such as electric arc, heating, high or audio frequency, contact procedures and electroshock techniques.

Figure 5:
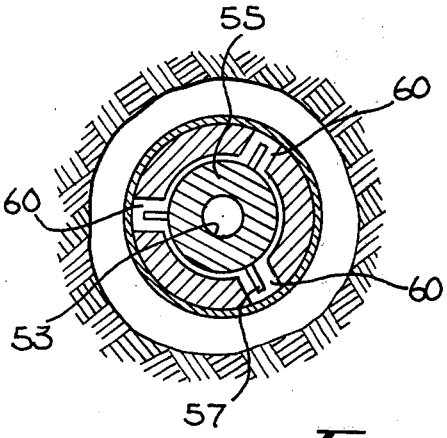
FIG. 5 is a cross-sectional view of the drilling lance.

FIG. 5 is a cross-sectional view of the bottom end 12 of lance 10. Illustrated in this FIGURE is the interrelationship between drill member housing 55 and lance recesses 60. Recesses 60 are grooves in the interior surface of bottom end 12 of lance 10 which extend in an axial direction from the lower portion of hydro-propulsion means 62 to the lowest extremity of bottom end 12. Disposed within these recesses 60 are housing wings 57. The wings 57 are generally rectangular members which protrude from drill member housing 55. Wings 57 are configured such that they are slideably disposed in recesses 60 in an axial direction, but radial displacement of wings 57 is limited by their abutment with recesses 60.

The interaction of wings 57 and recesses 60 serves two functions. First, it provides axial guidance for energy generating system 18 as it slides through lance 10. Second, it provides a check on the counter-torque developed by drilling means 24. That is, as the rotation of drilling means 24 is opposed by the material being drilled, a counter-torque is developed in drill housing 55. If this counter-torque went unchecked, an angular force would be placed on lance 10, which would result in an undesirable rotation of lance 10. In the present invention, the counter-torque is checked by the limited radial displacement of wings 57 in recesses 60. Thus, the counter-torque will rotate drill housing 55 until wings 57 abut recesses 60. Then, any further rotation will be stopped.

Figure 6:
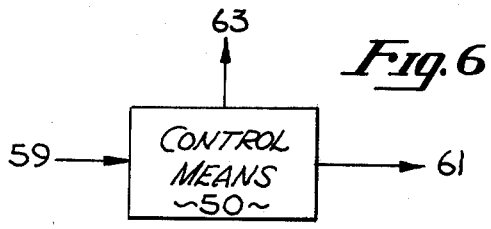
FIG. 6 is a block diagram of the control means.
Figure 7:
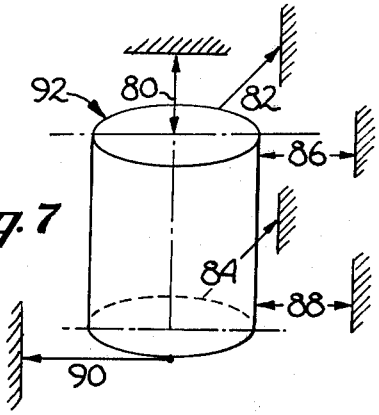
FIG. 7 is a perspective view of the force monitoring device.
Figure 8:
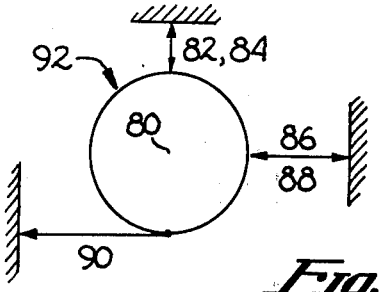
FIG. 8 is a top view of the force monitoring device.

Now referring to FIGS. 6, 7 and 8, control means 50 is illustrated with input sense lines 59 and output control lines 61. Input sense lines 59 are electrical couplings from force monitoring devices within lance 10. One such monitor, which is well known in the rocket guidance art, is a six component scale 92. As illustrated in FIGS. 7 and 8, such a scale, having the capacity to monitor six different vector components, monitors in the present invention: (i) forces exerted in a vertical direction 80; (ii) forces exerted in a first horizontal direction 82; (iii) forces exerted in a second horizontal direction 84; (iv) forces exerted in a third horizontal direction 86; (v) forces exerted in a fourth horizontal direction 88; and (vi) forces exerted in a tangential direction 90.

Control means 50, which in the presently preferred embodiment is a micro-processer, processes the monitor information from input sense lines 59 and produces output control signals 61. Control signals 61 are coupled to the hydro-propulsion means 51 and the hydro-motor 54 or electromotor 48. Control means 50, in a manner well known in the process control art, processes the monitor information and controls signals 61 so that an optimum ratio between the applied force on drilling means 24 and the rotation rate of drilling means 24 is maintained. In this manner, maximum drilling progress can be assured, while at the same time drill bits can be protected, since the drilling rate can be automatically adapted to the drilling conditions encountered. Thus, for example, as the drilling means progresses from a less dense and hard material to a more dense and hard material, the force applied to the drilling means and the rate of rotation of the drilling means will be automatically lessened. Control line 63 provides to the operator an indication of the drilling conditions encountered and provides a method for control of the lance from the surface.

Figure 2:
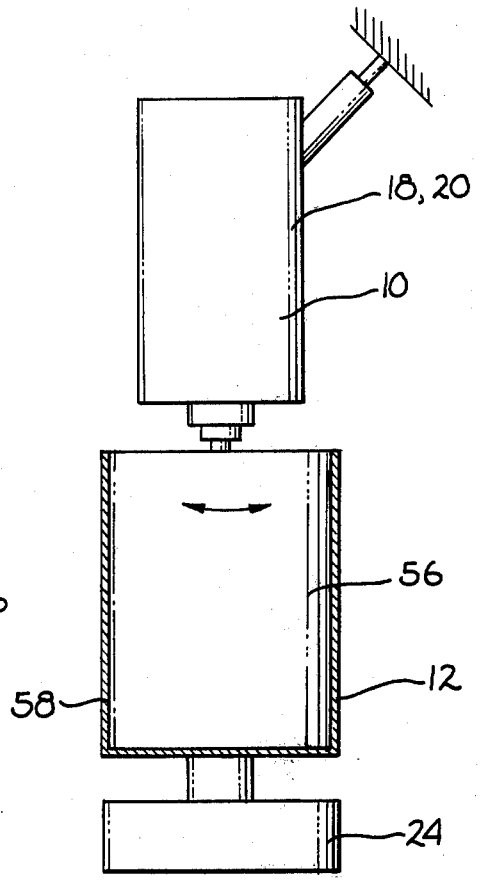
FIG. 2 is a diagrammatic illustration of an alternate embodiment of the drilling device of the present invention.

Now referring to FIG. 2 an alternate embodiment of the present invention may be seen. In this embodiment, a separate drilling means enclosure 56 is utilized. This enclosure has a bottom end 58 where drilling means 24 extends outwardly therefrom. The drilling means enclosure 56 is selectively coupled to the drilling lance 10 so that the drilling means enclosure may be oriented independently of the drilling lance 10. In this manner, a mechanical "mole" can drill independently of the lance and in optional directions.

There have been described herein a new and novel drilling device which has special utility for drilling at great depths in the earth's surface. However, it is to be understood that various alternate embodiments using the principles of the present invention may be readily incorporated by way of one specific example. Instead of the self-contained fuel containers of the present invention, fuel lines can be brought from the earth's surface to the drilling lance. Thus, while specific embodiments of the present invention have been disclosed and described in detail herein, it will be understood by those skilled in the art that various changes in form and detail may be made therein without departing from the spirit and scope of the invention.

What is claimed is:

1. A drilling device having special utility for drilling at great depths in the earth's surface, said drilling device comprising:

a tubular drilling lance having a top end and a bottom end, said drilling lance adapted to being lowered to great depths in the surface of the earth and being raised therefrom;

an energy generating system disposed in said lance, said energy generating system being characterized by:

a. a fluid vaporizing system, said fluid vaporizing system comprising:

i. at least one fuel container and fuel contained therein, said fuel container is a collapsable bellow-like container configured such that external pressure on said container provides a positive pressure on said fuel contained therein, ii. a reaction chamber coupled to said fuel container, iii. a heat exchanger coupled to said reaction chamber such that heat from said chamber is transferred to said heat exchanger, iv. vaporizable fluid communicating with said heat exchanger whereby said fluid is caused to vaporize by said heat, and v. condenser means directly coupled to said heat exchanger such that said fluid is selectively cooled and returned to said heat exchanger without loss of said fluid; and b. a turbine coupled to said vaporizing system by a closed fluid circuit such that said fluid is coupled from said heat exchanger to said turbine and further coupled from said turbine to said condenser means; and drilling means disposed adjacent to and extending outwardly from said bottom end of said drilling lance, said drilling means coupled to said turbine such that activation of said turbine by said fluid vaporizing system causes activation of said drilling means.

2. The apparatus according to claim 2 wherein said tubular drilling lance is a thin-walled hollow structure.

3. The apparatus according to claim 2 wherein said reaction chamber is cooled by the injection of a liquid coolant.

4. The apparatus according to claim 2 wherein said reaction chamber is coupled to said fuel container by a catalytic decomposer.

5. The apparatus according to claim 2 further comprising a coolant communicating with said condenser means.

6. The apparatus according to claim 5 wherein said coolant is mud.

7. The apparatus according to claim 2 wherein said drilling means is coupled to said turbine by means of direct mechanical linkage.

8. The apparatus according to claim 2 wherein said drilling means is coupled to said turbine by means of: (i) an electro-generator coupled to said turbine, and (ii) an electro-motor coupled to said drilling means such that electricity generated by said electro-generator is coupled to said electro-motor, making said motor operable.

9. The apparatus according to claim 2 further comprising control means whereby automatic control of the ratio between applied force and rate of rotation of said drilling means is automatically regulated and controlled.

10. Apparatus according to claim 2 wherein said drilling means is coupled to said turbine by means of: (i) a hydraulic pump coupled to said turbine, and (ii) a hydro-motor coupled to said drilling means such that activation of said pump makes said hydro-motor operable.

11. The apparatus according to claim 2 wherein said fuel comprises a hydrocarbon compound and an oxygen containing compound.

12. The apparatus according to claim 2 further comprising a separate drilling means enclosure, said enclosure having a bottom end and being configured such that said drilling means is disposed adjacent to and extending outwardly from said bottom end, said enclosure selectively coupled to said drilling lance.

13. The apparatus according to claim 12 wherein said drilling means enclosure may be oriented independently of said drilling lance.

14. The energy generating system of claim 2 further comprising a hydro-propulsion means, said means coupled to said drilling means such that expansion of said propulsion means extends said drilling means further from said lance.

15. The apparatus according to claim 18 wherein said energy generating system is slideably disposed in said drilling lance.

16. A drilling device having special utility for drilling at great depths in the earth's surface, said drilling device comprising:

i. a tubular drilling lance having a top end and a bottom end, said drilling lance adapted to being lowered to great depths in the earth's surface and being raised therefrom;

ii. an energy generating system slideably disposed in said lance, said system being characterized by:

a. a fluid vaporizing system, said system comprising:

i. at least one fuel container, said container being a collapsable bellow structure configured such that external pressure on said container provides a positive pressure on fuel contained therein, (ii) a reaction chamber coupled to said fuel container, said chamber being cooled by the injection of water and being coupled to one said fuel container by a catalytic decomposer, (iii) a heat exchanger coupled to said reaction chamber such that heat from said chamber is transferred to said heat exchanger, said heat exchanger being further coupled to said reaction chamber whereby water is extracted from said heat exchanger and injected into said reaction chamber, (iv) vaporizable fluid communicating with said heat exchanger whereby said fluid is caused to vaporize by said heat, said fluid selected from a group consisting of water and hologenated hydrocarbons, (v) condenser means directly coupled to said heat exchanger such that said fluid is selectively cooled and returned to said heat exchanger without loss of said fluid, said condenser means having a coolant communicating therewith, (vi) fuel disposed in said fuel container, said fuel comprising a hydrocarbon compound and oxygen containing compound;

b. a turbine coupled to said vaporizing system by a closed fluid circuit such that said fluid is coupled from said heat exchanger to said turbine and further coupled from said turbine to said condenser means;

c. hydro-propulsion means coupled to said turbine, said propulsion means being selectively expandable;

d. a hydraulic pump coupled to said turbine and a corresponding hydro-motor coupled to said hydraulic pump; and e. control means coupled to said hydro-motor and said hydro-propulsion means whereby control of the optimum ratio between expansion of said hydro-propulsion means and rate of rotation of said hydro-motor is automatically maintained;

iii. drilling means disposed adjacent to and extending outwardly from said bottom end of said drilling lance, said drilling means coupled to said turbine by said hydro-propulsion means, said hydraulic pump, and said hydro-motor such that activation of said turbine by said fluid vaporizing system causes activation of said drilling means, and such that selective expansion of said hydro-propulsion means extends said drilling means further from said lance;

iv. a fastening device disposed in said top end of said lance and coupled to said energy generating system such that said system is selectively coupled to said lance.

17. A drilling device having special utility for drilling at great depths in the surface of the earth, said drilling device comprising:

a tubular drilling lance having a top end and a bottom end, said drilling lance adapted to being lowered to great depths in the surface of the earth and being raised therefrom;

an energy generating system disposed in said lance, said energy generating system being characterized by:

a. a fluid vaporizing system, said fluid vaporizing system comprising:

i. at least one fuel container and fuel contained therein, said fuel container is a blatter configured such that external pressure on said container provides a positive pressure on said fuel contained therein, ii. a reaction chamber coupled to said fuel container, iii. a heat exchanger coupled to said reaction chamber such that heat from said chamber is transferred to said heat exchanger, iv. vaporizable fluid communicating with said heat exchanger whereby said fluid is caused to vaporize by said heat, and v. condenser means directly coupled to said heat exchanger such that fluid is selectively cooled and returned to said heat exchanger without loss of said fluid; and b. a turbine coupled to said vaporizing system by a closed fluid circuit such that said fluid is coupled from said heat exchanger to said turbine and further coupled from said turbine to said condenser means; and drilling means disposed adjacent to and extending outwardly from said bottom end of said drilling lance, said drilling means coupled to said turbine such that activation of said turbine by said fluid vaporizing system causes activation of said drilling means.

18. A drilling device having special utility for drilling at great depths in the surface of the earth, said drilling device comprising:

a tubular drilling lance having a top end and a bottom end, said drilling lance adapted to being lowered to great depths in the surface of the earth and being raised therefrom;

an energy generating system slidably disposed in said lance, said energy generating system being characterized by:

a. a fluid vaporizing system, said fluid vaporizing system comprising:

i. at least one fuel container and fuel contained therein, ii. a reaction chamber coupled to said fuel container, iii. a heat exchanger coupled to said reaction chamber such that heat from said chamber is transferred to said heat exchanger, iv. vaporizable fluid communicating with said heat exchanger whereby said fluid is caused to vaporize by said heat, v. condenser means directly coupled to said heat exchanger such that said fluid is selectively cooled and returned to said heat exchanger without loss of said fluid;

b. a turbine coupled to said vaporizing system by a closed circuit such that said fluid is coupled from said heat exchanger to said turbine and further coupled from said turbine to said condenser means; and c. a hydro-propulsion means, said hydro-propulsion means coupled to a drilling means such that expansion of said propulsion means extends said drilling means further from said lance;

drilling means disposed adjacent to and extending outwardly from said bottom end of said drilling lance, said drilling means coupled to said turbine such that activation of said turbine by said fluid vaporizing system causes activation of said drilling means; and a fastening device, said device disposed in said lance and coupled to said energy generating system such that said system is selectively coupled to said lance.

* * * * *